US007221109B2

(12) United States Patent
Toms

(10) Patent No.: US 7,221,109 B2
(45) Date of Patent: May 22, 2007

(54) STAGE LIGHTING CONSOLE

(76) Inventor: Robert Toms, 4882 Avenue A, Rapid City, SD (US) 57703

( * ) Notice: Subject to any disclaimer, the term of this patent is extended or adjusted under 35 U.S.C. 154(b) by 178 days.

(21) Appl. No.: 10/994,036

(22) Filed: Nov. 18, 2004

(65) Prior Publication Data

US 2006/0103333 A1 May 18, 2006

(51) Int. Cl.
*H05B 39/00* (2006.01)
*H05B 37/00* (2006.01)

(52) U.S. Cl. ..... 315/312; 315/316

(58) Field of Classification Search ..... 315/312, 315/316, 301; 362/85, 86
See application file for complete search history.

(56) References Cited

U.S. PATENT DOCUMENTS 5,045,983 A * 9/1991 Shields ..... 362/293
5,921,659 A * 7/1999 Hunt et al. ..... 362/233
6,597,132 B2 * 7/2003 Hunt et al. ..... 315/316
6,894,443 B2 * 5/2005 Hunt et al. ..... 315/312

* cited by examiner

*Primary Examiner*—Shih-Chao Chen
*Assistant Examiner*—Minh Dieu A
(74) *Attorney, Agent, or Firm*—Gene R. Woodle

(57) ABSTRACT

Embodiments of a stage lighting console are disclosed which may be used to control the light level of a plurality of stage lighting interments. The stage lighting console includes a plurality of sliders, each of which may control a separate lighting instrument and several settings of multiple sliders may be recorded for later playback. The sliders move from a +100% position to a −100% position such that they may be used to add to or subtract from the illumination of lighting instruments.

10 Claims, 1 Drawing Sheet

STAGE LIGHTING CONSOLE

BACKGROUND OF THE INVENTION

1. Field of the Invention

The present invention relates generally to a console for setting stage lighting and more specifically to a stage lighting console which provides for a simple, efficient method of changing light levels of stage lights.

2. Background Information

In this country and around the world there are thousands of stages and similar venues which are lighted by a plurality of lights most often referred to as lighting instruments. In most cases it is possible to direct the lighting instruments to a particular area of the stage and to adjust the light level of each lighting instrument. That is, each lighting instrument may be made brighter or dimmer depending upon which light level settings provide the optimal appearance of the stage and the action upon the stage at any given time. During the performance of a relatively simple play, for example, there may be dozens of light level settings which are programmed to change at particular points during the production. Various audio or visual cues indicate the points at which the light level settings are to be changed during the production.

During rehearsals and at various other pre-production points, a person, often referred to as the operator, experiments with a variety of light level settings and lighting changes to determine the optimal or most dramatic light level settings during multiple stages of the production. Most modern stages have a lighting console which controls the various light level settings and allows them to be recorded in the proper sequence. During the production, the operator observes the various cues and, when the appropriate cue is given, manipulates a control and the proper, prerecorded, light level setting is automatically produced on stage.

With conventional stage lighting controls, difficulties often occur when an operator wishes to change a particular light level setting pre-production or, even, during a production. Most conventional lighting consoles are equipped with multiple slide controls that may be moved linearly from a setting of 0% to 100%. Movement of each slide control controls the light level of a particular lighting instrument or a combination of lighting instruments. That is, for example, movement of slide control 1 controls lighting instrument 1. When slide control 1 is at 0 the lighting instrument is off and, when slide control 1 is at 100, lighting instrument 1 is at its brightest. If, for instance, a stage had twenty lights, the operator would use slide controls 1 through 20 to set the light level for each of the 20 lighting instruments for each of multiple lighting configurations or lighting set. Each of these level settings may be recorded and changed or displayed in order when the appropriate cue is received.

With most conventional lighting consoles, the console either includes what is known as a patch table. Using the patch table, the various slide controls may be associated with a plurality (often forty-eight) channels or signals. A plurality of outgoing channels (often five hundred and twelve) are sent from the patch table in an industry standard DMX protocol to a separate dimmer. There are a number of conventional dimmers on the market. The dimmer is connected to the various lighting instruments. Based upon the DMX channels received from the patch table, it is the dimmer which actually sets the illumination level of the various lighting instruments. The dimmer is not considered a part of the instant invention. Slide control 1, for instance might be associated with channel 1 using the patch table.

Outgoing channel 1 directs the dimmer to set the light level of lighting instrument 1 based upon the signal from outgoing channel 1. Using the patch table, it is possible to associate more than one lighting instrument with a particular channel. That is, channel 1 might control lighting instruments 1, 3, and 5. Henceforth, it should be understood that a reference to setting a channel results in the setting of the lighting level of an associated lighting instrument and references to setting a lighting level with a slide control assume that the slide control sets the channel and the channel directs the dimmer to set the lighting level.

Conventional lighting consoles have what is often referred to as a highest takes precedence method of operation. That is, once a setting for a particular channel has been recorded, the setting will not change until the control slide has been moved to a higher point on the control. If, for example, channel 1 (and consequently lighting instrument 1) was recorded at 70% using slide control 1, slide control 1 must be moved to a point above 70% for a change to occur. If the operator wishes to increase this light level above 70%, the slide must be moved slowly upward until the operator notices a change in the light level (above 70%), move the slider to the new position and then record the change when using most conventional consoles. If the operator wishes to decrease the light level, the slide must be moved slowly upward until the 70% level is "captured," move the slide down to the desired level, and record this new level. There are other conventional methods to accomplish decreasing light levels including using a keypad.

Several problems relating to the above described method of changing light levels are apparent. Changes are slow, awkward, and require a certain skill and dexterity level.

The stage lighting console of the instant invention is believed to solve, in a new and unique fashion, the above described problems relating to recording and changing lighting levels and light level settings for a stage production.

One of the major objects of the present invention is to provide a stage lighting console which may be used to change lighting configurations or lighting sets in a simple and efficient manner.

Another objective of the present invention is to provide a stage lighting console which has control slides which operate in a lowest takes precedence mode or a summing mode of operation when changing settings rather than the highest takes precedence mode of operation used in conventional stage lighting consoles.

Another objective of the present invention is to provide a stage lighting console which is simple, safe, rugged, inexpensive, and easy to use.

These and other features of the invention will become apparent when taken in consideration with the following detailed description and the drawings.

SUMMARY OF THE INVENTION

The stage lighting console of the instant invention comprises a console. The console includes a plurality of sliders each of which may be used to set or control the light level of a particular lighting instrument of a stage. Each of the lighting elements of a stage may be set using one of the sliders. Once a lighting level setting has been set for a particular scene or segment of a production, all of the settings set with the sliders may be recorded using the console. The console also has replay means for replaying the various lighting level settings for segments of the production sequentially. The operator periodically activates the replay means upon receipt of an audio or visual cue to change the light level set for a particular segment.

The stage lighting console includes a built in computer and a monitor. The monitor displays the various settings programmed into the console.

Each slider moves within a slider rail which is affixed to the cover plate of the console. A slot in the cover plate accommodates movement of the slider along the length of the slider rail. In a neutral position, the sliders are at the center of the slider rail and may be moved in one direction calibrated to be from 0% illumination to 100% illumination of the appropriate stage lighting instrument. Each slider may also be moved in the opposite direction calibrated from 0% illumination to −100% illumination of the appropriate stage lighting instrument. The operation of the sliders may be explained in the following example. Slider one sets the illumination level of lighting instrument one on the stage by setting channel 1 at 20% and that level is recorded for a particular segment or lighting set. If the operator determines that the level would be better set at 30%, the slider is moved to +10% which changes the level from 20% to 30% (20%+10%). If the operator determines that the level would be better set at 15%, the slider is moved to −5% which changes the level from 20% to 15% (20%−5%). Once a setting has been recorded, the console rejects further input from the slide control until it is centered or returned to the zero position. Each slider has a center detent and spring mechanism such that the operator will feel a distinct "catch" when the slider reaches the center position. The operator must act against the spring in order to move the slider below zero or from 0% to −100%.

In another embodiment, each slider may be calibrated to operate from 0% to 100% above the center position and also from 0% to 100% below the center position. In this embodiment, if, for instance, lighting instrument one were set at 60% and that setting recorded; the operator could set the lighting instrument to below 60% by moving slider one to, for example, 45% below the center position. This would change the lighting level of lighting instrument one to 45%. To change the setting to a point above 60%, the operator would move slider one above the center position above 60% to the desired setting, much as described above.

Although the stage lighting console of the instant invention is described as being used for the setting the lighting on a stage, the stage lighting console could be easily adapted to set illumination for areas other than stages or to set sounds rather than light.

DESCRIPTION OF A PREFERRED EMBODIMENT

Figure 1:
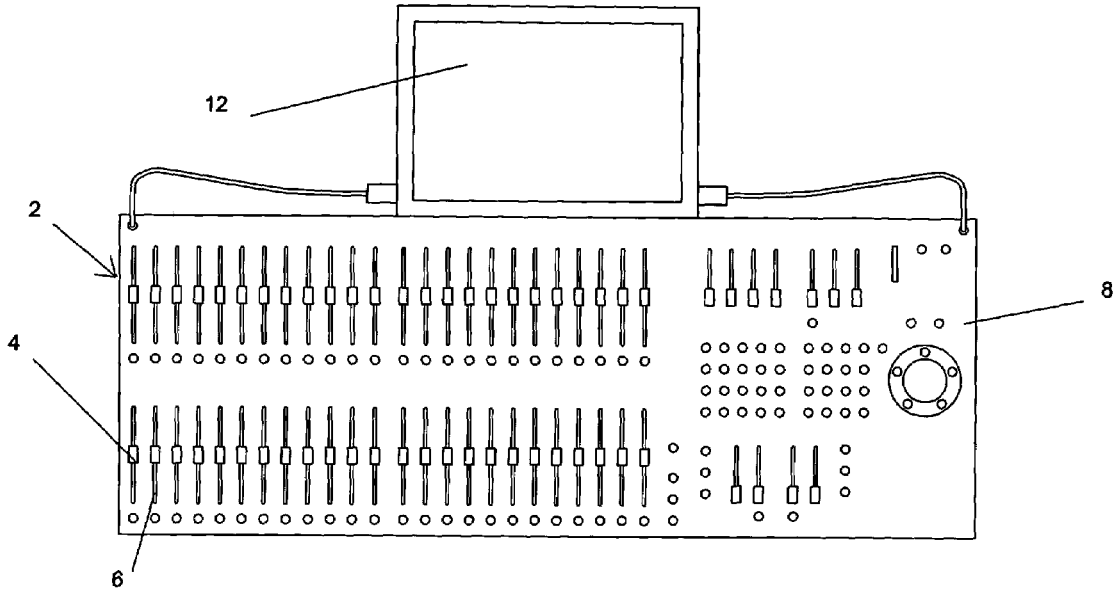
FIG. 1 is a top view of the stage lighting console of the instant invention.

Referring to the drawings, FIGS. 1 through 4, a preferred embodiment of the stage lighting console of the instant invention is shown.

Referring now to FIG. 1, the stage lighting console of the instant invention includes a console 2 which incorporates all of the various elements of the invention. The console 2 includes a plurality of sliders 4. The sliders 4 are capable of moving within slots 6 in a cover plate 8 on the top of said console 2. When centered as shown in FIG. 1, said sliders 4 are in a neutral or 0% position within the slots 6. Said sliders 4 may be moved in one direction from the 0% position to a 100% position and to all positions in between 0% and 100%. Said sliders 4 may be moved in the other direction from the 0% position to a −100% position and to all positions in between 0% and −100%.

Still referring to FIG. 1, said console 2 also includes a built-in CPU (not shown) which is connected to said sliders 4 and all other electronic elements within said console 2. A monitor 12 is affixed to said console 2 and also connected to the CPU. Controlled by the CPU, the monitor 12 displays the various settings of said sliders 4 and the other electronic components of said console 2. Said console 2 also includes a variety of other components such as record and replay buttons which are conventional and not described in detail here.

Figure 2:
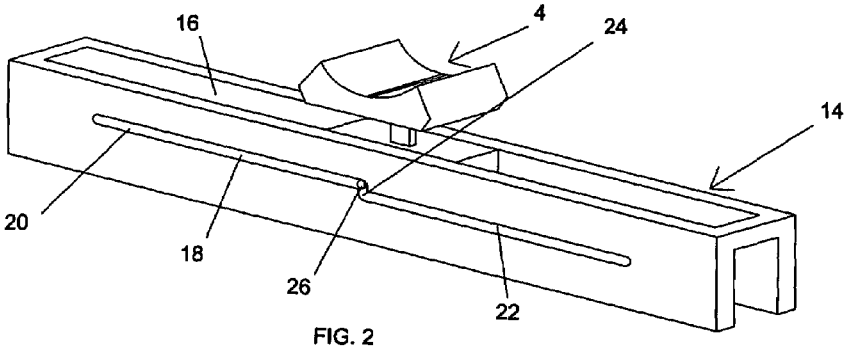
FIG. 2 is an isometric view of the slider and slider rail of the instant invention.

Referring now to FIG. 2, an isometric of view said slider 4 and a slider rail 14 is shown. The slider rail 14 includes a slider slot 16 along its length. The slider slot 16 corresponds to said slot 6 and said slider 4 moves within said slider slot 16 from a center or 0% position to a 100% position in one direction and from the 0% position to a −100% position in the other direction. Said slider slot 16 is on the top of said slider rail 14. There is a guide channel 18 on one of the sides of said slider rail 14. The guide channel 18 has a forward portion 20 which is slightly closer to the top of said slider rail 14 than the rearward portion 22. (For purposes of this explanation, forward is considered to be toward said monitor 12, but said slider rails 14 and incorporated components could move in any direction.) The forward portion 20 of the guide channel 18 is connected to the rearward portion 22 by a channel 24. Said slider 4 includes a pin 26 which projects outward into said guide channel 18. Said slider 4 may be moved from the 0% position forward within said slider slot 16 to a 100% position at the forward end of said slider slot 16 and to all points in between. When said slider 4 is moved rearward within said slider slot 16 to the 0% position it hits the wall of the channel 24 and may not be moved further rearward until said slider 4 is pressed downward and rearward. Said slider 4 may then be moved from the 0% position to the −100% position and to all points in between. Said slider 4 activates a conventional sensor which senses the position of said slider 4 and sends the position information to the CPU.

Figure 3:
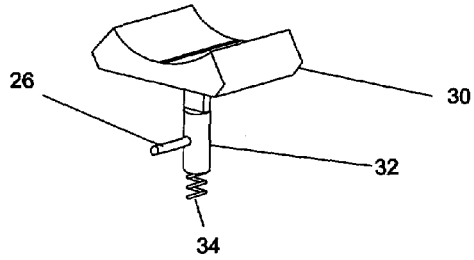
FIG. 3 is an isometric view of the slider button of the instant invention.

Now referring to FIG. 3, an isometric view of a button portion of said slider 4 is shown. A button 30 is provided and is affixed to the top of a button shaft 32. The pin 26 protrudes outward from the middle portion of the button shaft 32 as described above. Spring means 34 is affixed to the bottom of said button shaft 32. The spring means 34 engages a bottom plate (not shown) and tends to force said button shaft 32 upward.

Figure 4:
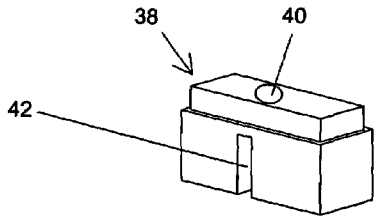
FIG. 4 is an isometric view of the slider block of the instant invention.

Now referring to FIG. 4, an isometric view of a slider block 38 is shown. The slider block 38 includes a hole 40 through its top center and a pin slot 42 which is in communication with the hole 40 and runs vertically from the bottom of said slider block 38 to a point just below the top of said slider block 38. Said slider block 38 may be inserted into said slider slot 16. Said button shaft 32 may be inserted through the hole 40 in said slider block 38. Said pin 26 may then be inserted through said guide channel 18 into said button shaft 32.

In operation, each of said sliders 4 controls the illumination level of a corresponding lighting instrument on the stage. For example, slider 4 one might control lighting instrument one and slider 4 two might control lighting instrument two. (As described previously, said sliders 4 actually control a corresponding channel which, in turn, signals a dimmer. The dimmer actally controls the lighting instruments; but, for simplicity, said sliders 4 are described as controlling the lighting instruments.) For each scene or segment of the production, the lighting level of lighting instrument one and lighting instrument two could be set using slider 4 one and slider 4 two. For segment one the lighting level of lighting instrument one could be set using slider 4 one to 70% of the total illumination possible by moving slider 4 one to the 70% position along said slider slot 16. The lighting level of lighting instrument two could be set using slider 4 two to 40% by moving slider 4 two to the 40% position. These settings could be recorded and stored in the memory of the CPU. For segment two the lighting level of lighting instrument one could be set using slider 4 one to 60% of the total illumination possible by moving slider 4 one to the 60% position along said slider slot 16. The lighting level of lighting instrument two could be set using slider 4 two to 50% by moving slider 4 two to the 50% position. These setting could be recorded and stored in the memory of the CPU. The operator, upon receiving the appropriate cues, may play back the memorized settings such that the stage is appropriately lighted for each segment. If, for example, the operator determined that there was too much light on the stage in segment one and too little light in segment two, the illumination levels could be changed using the appropriate sliders 4. To lower the illumination level of lighting instrument one, the operator would move said slider 4 one to the center position to make changes possible and then move said slider 4 one the −10% position to reduce the illumination level of lighting instrument one to 60%. To raise the illumination level of lighting instrument two in segment two, the operator would move said slider 4 two to the center position to make changes possible and then move said slider 4 two to the 20% position to increase the lighting level to 70%. The new setting could then be recorded for later play back. Of course, many more lighting instruments could be controlled by other sliders 4 and dozens of segments could be recorded rather than just two.

In another embodiment of the instant invention and again referring to FIG. 1, rather than being calibrated to move from 0% to +100% and from 0% to −100% said sliders 4 could be configured and calibrated to move above the center position from 0% to +100% and below the center position also from 0% at the bottom point of said slider 4 to +100% at the center position. In this embodiment the instant invention operates on a lowest takes precedence method of operation. For example, if lighting instrument one were set using said slider 4 one to 60% and that setting recorded; lighting instrument one could be set to a setting lower than 60% by moving said slider 4 one to, for instance, 40% below the center position. This would change the setting for lighting element one to 40%. To change the setting of lighting element one to a level above 60%, the operator would move said slider 4 one to the desired point above the center position. That is, lighting element one could be set to 80% by moving said slider 4 one to 80% above the center position. In all other aspects, the instant invention would operate as described above for the preferred embodiment except that the portion of said sliders 4 would operate in a lowest takes precedence method of operation.

In the preferred embodiment of the stage lighting console of the instant invention, unless otherwise specified; all elements are conventional or made from conventional materials. Said spring means 34 is made from a steel spring; but other spring means could be used.

Although the stage lighting console of the instant invention is described above as being used to control stage lighting, it could be easily adapted to set illumination for areas other than stages or to set sounds rather than light.

While preferred embodiments of this invention have been shown and described above, it will be apparent to those skilled in the art that various modifications may be made in these embodiments without departing from the spirit of the present invention.

I claim:

1. A stage lighting console for controlling the lighting level or illumination from zero to one hundred percent of a plurality of stage lighting instruments including:

(1) a console;

(2) a plurality of sliders slidably affixed to the console, each of the sliders being capable of moving through a range designated or calibrated from −100% to 100%, and each of said sliders being capable of controlling the lighting level of a lighting instrument and setting the lighting level from 0% of illumination to 100% of illumination;

(3) recording means within said console capable of recording the setting of each of said sliders; and (4) playback means within said console capable of playing back the recorded settings of each of said sliders such that the light level of any or all of the lighting instruments may be set by said sliders to form a lighting set, multiple additional lighting sets may be set using said sliders, all of the lighting sets can be recorded, and all of the lighting sets can be played back in sequence or in any order, and the lighting instruments upon the stage will reflect the lighting level setting recorded using said sliders;

whereby an operator may set the lighting levels of a plurality of stage lighting instruments, for multiple lighting sets, record each of the lighting sets, and replay the lighting sets in sequence or in any order.

2. The stage lighting console of claim 1 in which, after the setting of any of said sliders has been recorded, an operator may move any of said sliders to a negative setting and a new setting is created which is the original setting less the negative setting.

3. The stage lighting console of claim 2 in which said slider includes a detent and spring means such that when said slider reaches the 0% point, an operator will feel the detent indicating said slider has reached the 0% point and the operator will have to counter the tension on the spring means to continue moving said slider beyond the 0% point.

4. The stage lighting console of claim 1 in which said slider includes a detent and spring means such that when said slider reaches the 0% point, an operator will feel the detent indicating said slider has reached the 0% point and the operator will have to counter the tension on the spring means to continue moving said slider beyond the 0% point.

5. A stage lighting console for controlling the lighting level or illumination from zero to one hundred percent of a plurality of stage lighting instruments including:

(1) a console;

(2) a plurality of sliders slidably affixed to the console, each of the sliders being capable of moving through a range designated or calibrated from 0% to 100% in one direction A and from 100% to 0% in the other direction B, and each of said sliders being capable of controlling the lighting level of a lighting instrument and setting the lighting level from 0% of illumination to 100% of illumination;

(3) recording means within said console capable of recording the setting of each of said sliders; and (4) playback means within said console capable of playing back the recorded settings of each of said sliders such that the light level of any or all of the lighting instruments may be set by said sliders to form a lighting set, multiple additional lighting sets may be set using said sliders, all of the lighting sets can be recorded, and all of the lighting sets can be played back in sequence or in any order, and the lighting instruments upon the stage will reflect the lighting level setting recorded using said sliders;

whereby an operator may set the lighting levels of a plurality of stage lighting instruments, for multiple lighting sets, record each of the lighting sets, and replay the lighting sets in sequence or in any order.

6. The stage lighting console of claim 5 in which once a lighting instrument setting has been recorded, the illumination level may be reduced by moving the controlling slider in direction B to a percentage less than the recorded level and the illumination level may be increased by moving the controlling slider in direction A to a percentage greater than the recorded level.

7. The stage lighting console of claim 6 in which said slider includes a detent and spring means such that when said slider reaches the 0% point, an operator will feel the detent indicating said slider has reached the 0% point and the operator will have to counter the tension on the spring means to continue moving said slider beyond the 0% point.

8. The stage lighting console of claim 5 in which, after the setting of any of said sliders has been recorded, an operator may move any of said sliders to a negative setting and a new setting is created which is the original setting less the negative setting.

9. The stage lighting console of claim 8 in which said slider includes a detent and spring means such that when said slider reaches the 0% point, an operator will feel the detent indicating said slider has reached the 0% point and the operator will have to counter the tension on the spring means to continue moving said slider beyond the 0% point.

10. The stage lighting console of claim 5 in which said slider includes a detent and spring means such that when said slider reaches the 0% point, an operator will feel the detent indicating said slider has reached the 0% point and the operator will have to counter the tension on the spring means to continue moving said slider beyond the 0% point.

* * * * *